US006684046B2

(12) United States Patent
Hibino

(10) Patent No.: US 6,684,046 B2
(45) Date of Patent: Jan. 27, 2004

(54) IMAGE FORMING APPARATUS, IMAGE FORMING METHOD AND DEVELOPING APPARATUS

(75) Inventor: Masaru Hibino, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,339

(22) Filed: Jul. 30, 2001

(65) Prior Publication Data

US 2002/0025199 A1 Feb. 28, 2002

(30) Foreign Application Priority Data

Jul. 31, 2000 (JP) ..... 2000-231751

(51) Int. Cl.[7] ..... G03G 15/08
(52) U.S. Cl. ..... 399/267; 399/277
(58) Field of Search ..... 399/267, 277, 399/254

(56) References Cited

U.S. PATENT DOCUMENTS 5,991,585 A * 11/1999 Nakamura ..... 399/267
6,101,358 A * 8/2000 Imai et al. ..... 399/267
6,308,035 B1 * 10/2001 Fukuda ..... 399/254
6,324,369 B1 * 11/2001 Yamguchi et al. ..... 399/254

FOREIGN PATENT DOCUMENTS

JP 2000-194194 * 7/2000

* cited by examiner

*Primary Examiner*—Quana M. Grainger
(74) *Attorney, Agent, or Firm*—Fitzpatrick, Cella, Harper & Scinto

(57) ABSTRACT

An image forming apparatus has a non-magnetic rotatable cylinder having a diameter of 10 mm to 25 mm, a plurality of magnetic field generating means which is inside the non-magnetic cylinder and fixed, a developing container which houses a two component developer containing a magnetic carrier and a non-magnetic toner and has the non-magnetic cylinder rotatably mounted at an opening portion thereof, agitating conveyer means which is inside the developing container and agitates the two component developer and conveys it to the non-magnetic cylinder, and an image bearing member arranged in opposition to the non-magnetic cylinder at intervals. The image forming apparatus is an image forming apparatus which conveys the two component developer by the rotation of the non-magnetic cylinder, and an electrostatic latent image on the image bearing member is magnetic-brush-developed.

6 Claims, 2 Drawing Sheets

IMAGE FORMING APPARATUS, IMAGE FORMING METHOD AND DEVELOPING APPARATUS

BACKGROUND OF THE INVENTION

Field of the Invention and Related Background Arts

The present invention relates to an image forming apparatus and method for forming an image by developing an electrostatic latent image formed on an image bearing member corresponding to an image to be recorded and recording it on a recording medium such as a plain paper. Furthermore, the present invention relates to a developing apparatus used for the image forming apparatus.

Heretofore, various types of electrophotographic developing apparatuses have been proposed and put into practical use. In general, they are classified into developing apparatuses using a one component developing system and developing apparatuses using a two component developing system. The one component system is a non-contact system in most cases, and as a representative example, there is a one component jumping developing system which uses a magnetic toner.

This developing system can provide a high quality image with a simple constitution. However, a clear color image cannot be provided because the toner contains a magnetic material. Further, in the case of the one component developing system using a nonmagnetic toner, although a color image can be provided, it is difficult to have the toner applied to a developing sleeve stably for a long period. Even when the non-magnetic toner is coated on the developing sleeve with an elastic blade, it is necessary to further improve its stability and durability.

On the other hand, in a two component developing method, development is carried out by conveying toner to a developing area using a magnetic carrier, and usually a developing process is carried out by bringing a developer into contact with a photosensitive drum. The developing process will be described with reference to FIG. 2. In FIG. 2, reference numeral 30 denotes a developing sleeve, reference numeral 35 a magnetic roller fixedly disposed inside the developing sleeve, reference numerals 31 and 32 agitating screws, reference numeral 33 a control blade disposed for forming the developer in a thin layer on the developing sleeve surface and reference numeral 34 a developer container.

The developing process for visualizing the above-described electrostatic latent image using a two component magnetic brush method, by using the above-described developing apparatus and a circulating system of the developer, will be described below. By rotation of the developing sleeve 30, developer drawn up at an N3 pole is controlled by the control blade 33 during the process of being conveyed from an S2 pole to an N1 pole and formed in a thin layer on the developing sleeve 30. When the developer formed in a thin layer is conveyed to a developing main pole S1, an ear-up is formed by a magnetic force. Using the developer formed in the ear-up shape, the above-described electrostatic latent image is developed, and, after that, the developer on the developing sleeve 30 is returned to the interior of the developing container 34 by a repulsive magnetic field of the N2 pole and the N3 pole. In the two component development method, as described above, magnetic poles generally having the same polarity are arranged side by side, and the unused developer, after the development process, is stripped off the developing sleeve so that no image hysteresis remains.

The developing sleeve is applied with a direct current bias and an alternating current bias from a power supply source (not shown). Generally, in the two component developing method, the application of an alternating current bias increases developing efficiency and enhances image quality.

As for latent image forming methods, there have been known such methods wherein an electrophotographic photosensitive member is scan-exposed by a laser beam, which is modulated in correspondence with the signal of an image to be recorded, and an electrostatic latent image is formed by distributing the latent image in a dot shape in correspondence with the image. Among those methods, however, the so-called pulse width modulation (PWM) method which modulates the width (that is, the duration) of a laser drive pulse current in correspondence with the shade of the image to be recorded can obtain a high recording density (that is, a high resolution) and also can obtain a high gradation.

In recent years, development has been made to attain miniaturization and longevity of the two component developing device. In order to achieve miniaturization from a development process side, it is necessary to miniaturize the container, the developing sleeve and the agitating conveyance screw. Making the space of a developer-reservoir portion smaller at a developer layer thickness control portion is also one of the effective methods. Execution of these steps of miniaturization and space reduction will severely reflect upon component accuracy and various latitudes and hence an elaboration of various ideas is necessitated.

In order to attain longevity, it is necessary to prevent deterioration of the toner and the carrier. For this purpose, there is required a constitution wherein the developer is not compressed. The location in which the developer is compressed is the developer layer thickness control portion and, in a usual constitution, the developer layer thickness control pole (the S2 pole in FIG. 2) is situated further in the upper stream of the rotational direction of the developing sleeve than the control blade and the developer attracted to a developer layer thickness control pole in this area is compressed between the sleeve and the container. To reduce the compression of the developer, it is most effective to reduce a force (Fr: a magnetic attraction force which works in the vertical direction relative to the developing sleeve) by which the developer layer thickness control pole attracts the developer to the developing sleeve.

As a method for that purpose, there can be cited such methods as minimizing a magnetization of the magnetic carrier inside the developer and constructing a magnet pattern in which a magnetic line of force from the developer layer thickness control pole is difficult to go around adjacent magnetic poles, but goes out as vertically as possible from the developing sleeve. Minimizing the magnetization of the carrier can be said to be one of various means for achieving high quality from a point that a force rubbing the toner image, which has been developed on the photosensitive member, becomes weaker.

As one of the latter methods, there has been proposed a developing method, which uses one of the repulsive magnetic poles of the magnet roller as a developer layer thickness control pole. When a repulsive magnetic field is formed with magnetic poles of the same polarity being side-by-side, the magnetic lines of force of each magnetic pole go out almost vertically to the developing sleeve. In this case, a rate of change in a magnetic flux density in the vertical direction relative to the developing sleeve is small. As a result, the force, which attracts the developer to the developing sleeve, becomes smaller and a condensation of the developer is reduced. It has been considered that, by implementing both of the above-described methods, still greater longevity can be attained.

Regarding a constitution to form the repulsive magnetic field, if the developer layer thickness control pole, which is one of the repulsive magnetic poles, is arranged downstream of the gravitational direction relative to the stripping off pole, which is another magnetic pole forming the repulsive magnetic field, it is much easier to draw up the developer to be coated on the developing sleeve and the constitution becomes simpler. As described above, such a constitution may possibly reduce the reservoir amount of the developer in the developer layer thickness control portion and may also lead to miniaturization of the developer container.

However, in the case where a constitution using one of the repulsive magnetic poles as the developer layer thickness control pole is adapted to a small size developing sleeve, a screw pitch-like density irregularity easily occurs at the rear end of a solid black image. This phenomenon occurs due to the fact that a mixing ratio of the developer (having an image hysteresis) with the toner density reduced, which moves to the developer layer thickness control pole after having been stripped off by the repulsive magnetic field, and the developer which is agitated and conveyed by the screw in the vicinity of the developing sleeve and supplied to the developer layer thickness control pole, changes by a rotational cycle of the screw at a longitudinal image area.

The phenomenon as described above is apt to occur when the developer surface (the topmost surface of the developer conveyed by the screw) is situated relatively downward in the gravitational direction inside the developer container and the agitating conveyer screw is installed in the vicinity of the developer layer thickness control pole. Further, this phenomenon is apt to occur when a size of magnetization of the magnetic carrier is small. This is because, in the case of the above-described constitution, the developer after a development process is difficult to strip off using a stripping pole and easy to move to the developer layer thickness control magnetic pole.

SUMMARY OF THE INVENTION

It is an object of the present invention to provide an image forming apparatus, an image forming method and a developing apparatus, wherein miniaturization and longevity of two component developer can be attained and a screw pitch-like density irregularity can be controlled.

It is an object of the present invention to provide an image forming apparatus, comprising: a non-magnetic rotatable cylinder having a diameter of 10 mm to 25 mm; a plurality of magnetic field generating means disposed inside the non-magnetic cylinder and fixed relative thereto; a developer container which houses a two component developer containing a magnetic carrier and a non-magnetic toner and has the non-magnetic cylinder rotatably mounted at an opening portion thereof; agitating conveyer means, disposed inside the developing container, which agitates the two component developer and conveys it to the non-magnetic cylinder; and an image bearing member arranged in opposition to the non-magnetic cylinder at intervals, wherein the image forming apparatus conveys the two component developer by rotation of the non-magnetic cylinder and an electrostatic latent image on the image bearing member is magnetic-brush-developed, the magnetic field generating means comprises: a developer layer thickness control pole for controlling a developer layer thickness on the non-magnetic cylinder of the developer supplied by the agitating conveyer means; and a stripping off pole having the same magnetic polarity as the developer layer thickness control pole and arranged adjacent to the thickness control pole in the upper side of the gravitational direction of the control pole and forming the magnetic field for stripping off the two component developer supplied for development from the non-magnetic cylinder, the peak value of the strength of the magnetic field of the developer layer thickness control pole in the vertical direction relative to an outer peripheral surface of the non-magnetic cylinder is 0 tesla to 0.02 tesla in absolute value not less than the peak value of the strength of the magnetic field of the stripping off pole in the vertical direction relative to the outer peripheral surface, and the agitating conveyer means is installed in such a manner that the topmost surface of the developer conveyed by the agitating conveyer means is situated between the peak position of the strength of the magnetic field of the developer layer thickness control pole in the vertical direction relative to the outer peripheral surface of the non-magnetic cylinder and the peak position of the strength of the magnetic field of the above described stripping off pole in such direction.

Further, it is an object of the present invention to provide an image forming method, comprising: providing a non-magnetic rotatable cylinder having a diameter of 10 mm to 25 mm; providing a plurality of magnetic field generating means disposed inside the non-magnetic cylinder and fixed relative thereto; providing a developing container which houses a two component developer containing a magnetic carrier and a non-magnetic toner, the non-magnetic cylinder being rotatably mounted at an opening portion thereof; providing agitating conveyer means, disposed inside the developer container, which agitates the two component developer and conveys it to the non-magnetic cylinder; and providing an image bearing member arranged in opposition to the non-magnetic cylinder at intervals, the two component developer being conveyed by rotation of the non-magnetic cylinder and an electrostatic latent image being magnetic-brush-developed on the image bearing member, wherein providing the magnetic field generating means comprises: providing the developer layer thickness control pole for controlling the developer layer thickness on the non-magnetic cylinder of the developer supplied by the agitating conveyer means; and providing a stripping off pole having the same magnetic polarity as the developer layer thickness control pole and arranged adjacent to the thickness control pole in the upper side of the gravitational direction of the thickness control pole and forming the magnetic field for stripping off the two component developer supplied for development from the non-magnetic cylinder, wherein the peak value of the strength of the magnetic field of the developer layer thickness control pole in the vertical direction relative to an outer peripheral surface of the non-magnetic cylinder is 0 tesla to 0.02 tesla in absolute value not less than the peak value of the strength of the magnetic field of the stripping off pole in the vertical direction relative to the outer peripheral surface, and the agitating conveyer means is installed in such a manner that the topmost surface of the developer conveyed by the agitating conveyer means is situated between the peak position of the strength of the magnetic field of the developer layer thickness control pole in the vertical direction relative to the outer peripheral surface of the non-magnetic cylinder and the peak position of the strength of the magnetic field of the stripping off pole in such the direction.

Further, it is an object of the present invention to provide a developing apparatus, comprising: a non-magnetic rotatable cylinder having a diameter of 10 mm to 25 mm; a plurality of magnetic field generating means disposed inside the non-magnetic cylinder and fixed relative thereto; a developing container which houses a two component developer containing a magnetic carrier and a non-magnetic toner, the non-magnetic cylinder being rotatably mounted at an opening portion thereof; and agitating conveyer means, disposed inside the developer container, which agitates the two component developer and conveys it to the non-magnetic cylinder, wherein the developing apparatus conveys the two component developer by rotation of the non-magnetic cylinder and an electrostatic latent image on the image bearing member of the image forming apparatus comprising the image bearing member arranged in opposition to the non-magnetic cylinder at intervals is magnetic-brush-developed, the magnetic field generating means comprises: the developer layer thickness control pole for controlling the developer layer thickness on the non-magnetic cylinder of the developer supplied by the agitating conveyer means; and a stripping off pole having the same magnetic polarity as the developer layer thickness control pole and arranged adjacent to the thickness control pole in the upper side of the gravitational direction of the thickness control pole and forming the magnetic field for stripping off the two component developer supplied for development from the non-magnetic cylinder, the peak value of the strength of the magnetic field of the developer layer thickness control pole in the vertical direction relative to an outer peripheral surface of the non-magnetic cylinder is 0 tesla to 0.02 tesla in absolute value not less than the peak value of the strength of the magnetic field of the stripping off pole in the vertical direction relative to the outer peripheral surface, and the agitating conveyer means is installed in such a manner that the topmost surface of the developer conveyed by the agitating conveyer means is situated between the peak position of the strength of the magnetic field of the developer layer thickness control pole in the vertical direction relative to the outer peripheral surface of the non-magnetic cylinder and the peak position of the strength of the magnetic field of the stripping off pole in such direction.

DETAILED DESCRIPTION OF THE PREFERRED EMBODIMENTS

Figure 1:
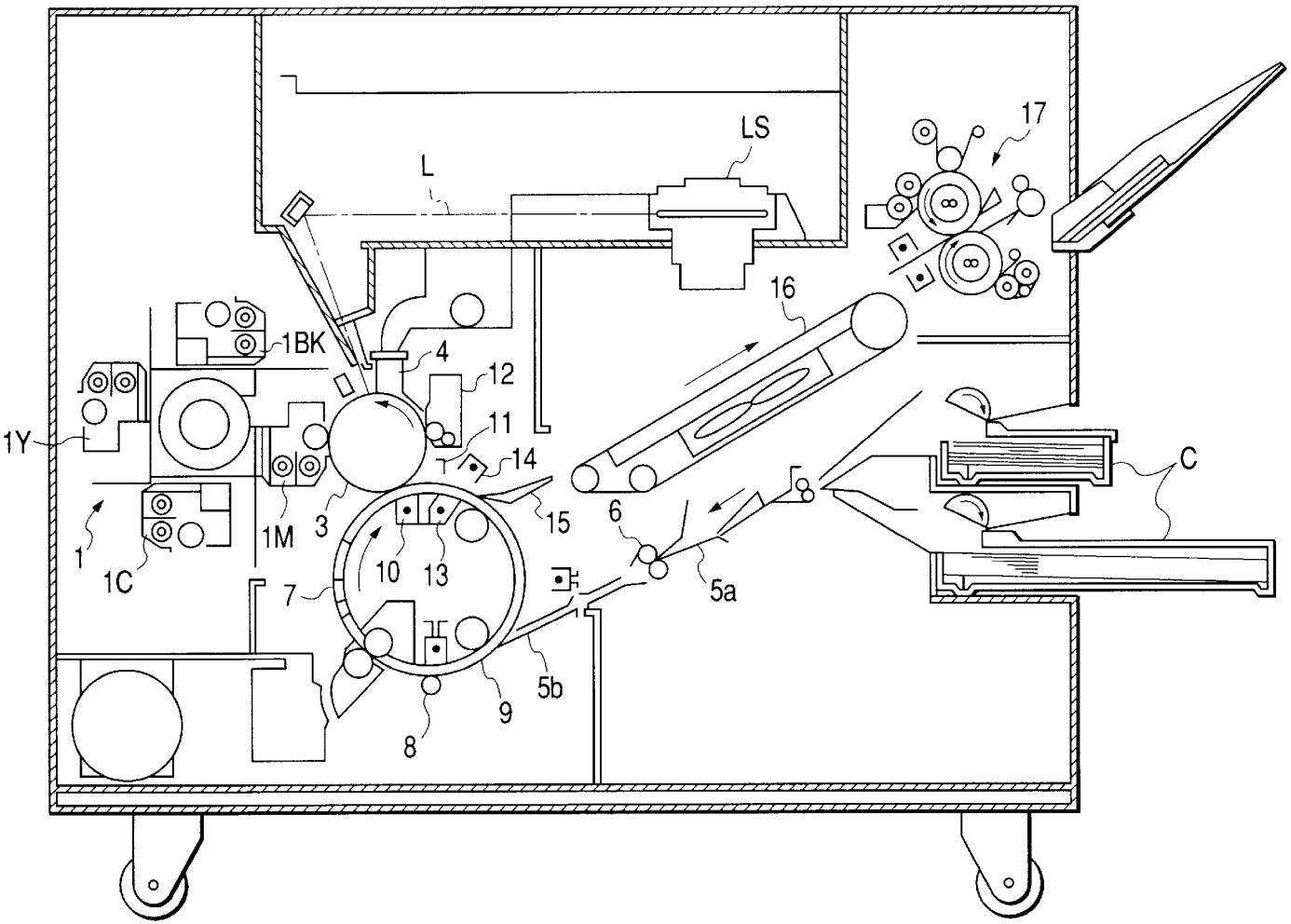
FIG. 1 is a longitudinal sectional view showing one example of an image forming apparatus for forming a full color image according to the present invention.
Figure 2:
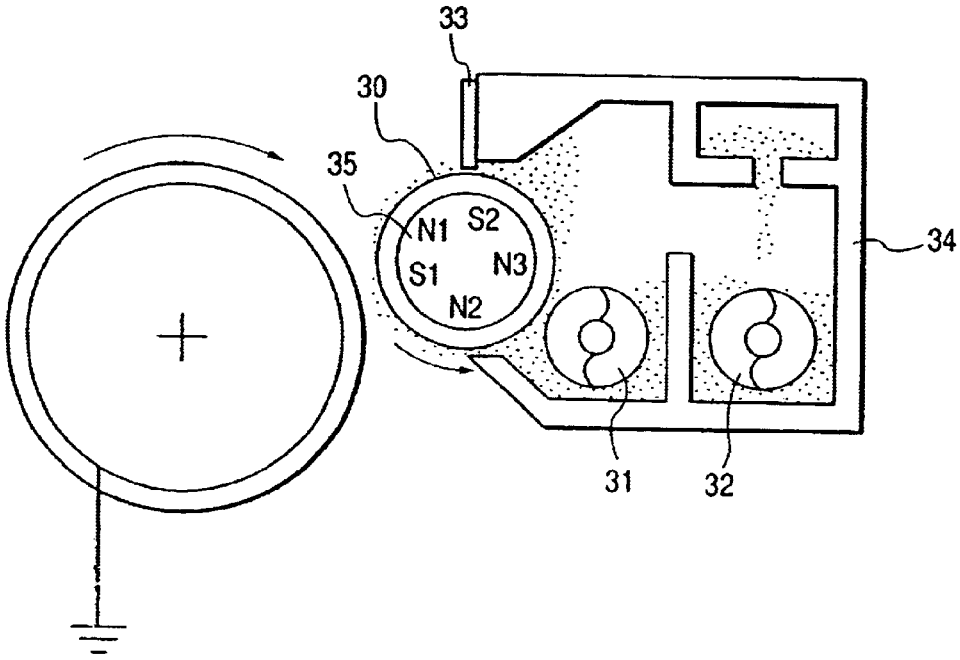
FIG. 2 PRIOR ART
FIG. 2 is a sectional view showing a known developing device which was used when describing the conventional example.

According to the present invention, by adopting the constitution as described above, it is possible to miniaturize the apparatus and increase the longevity of two component developer and, at the same time, to obtain a uniform and stable image over the whole surface for a long period of time.

Further, if development is performed in the case where the image bearing member and the non-magnetic cylinder mutually move in a reverse directions at the developing portion, the present invention provides further improvement of image quality in the image forming operation.

Further, if the magnetic carrier in the two component developer has a magnetization of $3.0\times10^4$ A/m to $2.0\times10^5$ A/m in 0.1 tesla of magnetic field, the present invention provides further improvement of the image quality in the image formation and longevity of the carrier particles, the non-magnetic cylinder and the like.

The non-magnetic cylinder has a diameter of 10 mm to 25 mm as an index for achieving miniaturization of the developing apparatus and the image forming apparatus. When the diameter of the non-magnetic cylinder deviates from this range, there sometimes occur problems in that the magnetic field formed by the magnetic field generating means is not effectively formed and the desired longevity of the developer cannot be attained, or miniaturization of the apparatus cannot be achieved.

The non-magnetic cylinder is preferably formed by a conductive material and, as such a material, there can be illustrated various types of materials conventionally known, for example, a metal such as stainless steel or aluminum, or a resin having conductivity generated therein by dispersion of conductive particles therein. Further, the non-magnetic cylinder may be given a finishing process such as surface roughening of a surface by a blasting process in order to enhance a conveyance ability of the two component developer.

The magnetic field generating means has a plurality of magnetic units fixed inside the non-magnetic cylinder so that they become relatively immovable against the non-magnetic cylinder. The magnetic field generating means may be either permanent magnetic means, such as a magnet always generating the magnetic field, or controlled magnetic means, such as an electromagnet capable of randomly generating a certain magnetic field or a magnetic field of a different polarity.

The developer layer thickness control pole is one of the magnetic field generating means and constituted in such a manner as to bear the magnetic carrier contained in the two component developer on the non-magnetic cylinder surface in a predetermined layer thickness. Further, the stripping off pole is similarly one of the magnetic field generating means and constituted in such a manner as to form a magnetic field for stripping off from the non-magnetic cylinder developer returned to the interior of the developer container by being borne and conveyed on the non-magnetic cylinder after having been supplied for development. The stripping off pole and the developer layer thickness control pole are of the same polarity and, further, the stripping off pole is arranged further upward in the gravitational direction of the developer layer thickness control pole.

When constituted as above, because the poles form a repulsive magnetic field, the magnetic lines of force between the poles tend to emanate in the vertical direction relative to the non-magnetic cylinder outer peripheral surface. As a result, a rate of change of the magnetic field (a density of the magnetic lines of force) in such direction becomes smaller and a force attracting the two component developer to the non-magnetic cylinder becomes smaller. For this reason, the developer easily drops away while it passes over the stripping off pole and a recovery of the developer can be realized by a simple constitution.

Further, when constituted as above, because the magnetic lines of force of the developer layer thickness control pole tend to emanate in the vertical direction relative to the non-magnetic cylinder outer peripheral surface, a force that tends to press the developer to the non-magnetic cylinder becomes smaller and a force that tends to compress the developer in the vicinity of the developer layer thickness control pole becomes weaker, so that increased longevity of the developer is attained with a simple constitution.

Further, the peak value of the strength of the magnetic field in the vertical direction relative to the non-magnetic cylinder outer peripheral surface of the developer layer thickness control pole is taken in absolute value as not less than 0 tesla or not more than 0.02 tesla of the peak value of the strength of the magnetic field in the vertical direction relative to the outer peripheral surface of the stripping off pole. Preferably, the peak value of the developer layer thickness control pole is not less than 0.04 tesla and not more than 0.1 tesla, and the peak value of the stripping off pole is not less than 0.04 tesla and not more than 0.08 tesla. According to this constitution, the circulation of the developer becomes smoother around the non-magnetic cylinder.

To describe the range of the difference of the peaks, when the peak value is below 0 tesla (that is, the strength of the magnetic field of the developer layer thickness control pole is smaller than the strength of the magnetic field of the stripping off pole), the returned developer in the vicinity of the stripping off pole reservoirs too much, while the developer in the vicinity of the developer layer thickness control pole reservoirs too little. Thus, irregularity of the developer on the non-magnetic cylinder easily occurs and a faulty image sometimes is produced. Further, when the peak value is not less than 0.02 tesla, the developer stripped off from the non-magnetic cylinder is attracted to the developer layer thickness control pole without being influenced by the agitation of the agitating conveyer means (to be described later) and supplied in the next development operation with an image hysteresis remaining undeleted, so that a faulty image due to decreasing image density and pitch irregularity of the agitating conveyer means are sometimes produced.

The peak value of the strength (Br) of the magnetic field of both poles can be measured by the following method.

In the present invention, in order to calculate a magnetic flux density Br of a normal direction in the position on the developing sleeve (the non-magnetic cylinder) surface, a measurement was made by a Gauss meter Model 640 manufactured by Bell Co. The developing sleeve was horizontally fixed and a magnet (magnetic field generating means) inside the developing sleeve was rotatably attached. The Gauss meter has a measuring probe which maintains a very minute gap with the developing sleeve and is horizontally fixed in such a manner that the center of the developing sleeve and the center of this probe are almost on the same horizontal plane. This measuring probe is connected with the Gauss meter and measures the magnetic flux density on the developing sleeve surface. The developing sleeve is almost coaxial with the magnet and the gap between the developing sleeve and the magnet may be considered to be equal at any place. Accordingly, by rotating the magnet, the magnetic flux density Br of the normal direction in the position on the developing sleeve can be measured for all of the peripheral directions. The peak value of the strength of the magnetic field can be calculated from this measuring result for both dimension and position.

If the constitution is only as described above, the stripped off developer drops and is influenced as it is by the developer layer thickness control pole. However, in the present invention, the agitating conveyer means is used, and this agitating conveyer means is installed in such a manner that the topmost surface of the developer conveyed by the agitating conveyer means is positioned between the position of the peak strength of the magnetic field of the developer layer thickness control pole and the position of the peak strength of the magnetic field of the stripping off pole.

According to this constitution, the returned developer which was stripped off from the non-magnetic cylinder at the stripping off pole, when dropped, reaches the agitating conveyer means before being influenced by the magnetic field of the developer layer thickness control pole and is agitated with another (for example, new) developer and hence the image hysteresis is deleted until it is conveyed again to the non-magnetic cylinder and a supply of the developer is continued without producing any image faults.

As such agitating conveyer means, there can be cited various types of conventionally known means. For example, agitating conveyer apparatus in which a rotary arm is installed with an elastic resin plate or a conveyance screw in which a rotatable body is installed with a screw-shaped blade can be cited. In the present invention, it is preferable that a conveyance screw, which has a good agitating efficiency at the conveying time, be used. When the agitating conveyer means is constituted by utilizing a rotatable body having an axis of rotation extending in the same direction as the non-magnetic cylinder, it is preferable that its rotational direction be a counter direction to the rotational direction of the non-magnetic cylinder.

The developer container is good if it is adequate for housing the two component developer and a variety of constitutions can be used, which have been conventionally known. The developing container forms more than two housing spaces with a partition wall installed in its interior, and one housing space can be taken as a space for supplying developer to the non-magnetic cylinder and the other housing space can be taken as a space for supplying new developer to such space. It is preferable that the other housing space be installed with another agitating conveyer means for agitating the developer to be housed and conveying it to the adjacent space. Further, it is preferable that the "another" space be installed with replenishing means for replenishing a new non-magnetic toner as occasion demands.

In addition to the above-described constitution, in the present invention, the "another" agitating conveyer means, replenishing means and another member, such as a control blade for controlling the layer thickness of the developer on the non-magnetic cylinder, can be further provided. Further, in the present invention, each apparatus and the like which constitute the image forming apparatus including the developing apparatus of the present invention can be made into a process cartridge which is integrally and detachably or attachably constituted.

Further, in the present invention, though a process direction in development is not particularly limited, the development is preferably performed by moving the image bearing member and the non-magnetic cylinder in opposite directions in order to prevent reservoiring of the developer in the developing portion from occurring and to form an image of a higher quality. The developing portion is an opposing portion between the image bearing member and the non-magnetic cylinder, which is an area where movement of the toner in the developer to the image bearing member is performed.

The two component developer used in the present invention contains a non-magnetic toner and a magnetic carrier.

The non-magnetic toner is not particularly limited, if it is a non-magnetic toner which has been known and used in a two component developer. The non-magnetic toner is constituted by using an adequate amount of a binder resin such as styrene system resin or polyester resin; coloring agent such as carbon black, dyes, pigment and the like; releasing agent such as wax; and charge controlling agent. Such a non-magnetic toner can be produced by a normal method such as a pulverizing method and a polymerizing method.

It is preferable that the non-magnetic toner has an amount of frictional electrification of $-1\times10^{-2}$ to $-4.5\times10^{-2}$ C/kg. If the amount of frictional electrification of the non-magnetic toner deviates from this range, a developing efficiency is easily reduced and a faulty image is sometimes produced. The amount of frictional electrification of the non-magnetic toner may be adjusted by varying the types of materials to be used and the like or may be adjusted by an external additive (to be described later).

The amount of frictional electrification of the non-magnetic toner can be measured by the usual blow-off method by drawing up the toner from the developer, with the toner amount taken as about 0.5 to 1.5 g by drawing up air and by measuring a charge amount induced in a measuring container.

Further, it is preferable that the non-magnetic toner has a volume average particle size of 4 to 15 $\mu$m. Here, for the volume average particle size of the non-magnetic toner, for example, the numerical value measured by the following measurement method is adopted.

As for a measuring apparatus, a Coulter counter Model TA-II (manufactured by Coulter, Inc.) is used, and an interface (manufactured by NIKKAKI CO., LTD.) for outputting a number average distribution and a volume average distribution and a personal computer Model CX-i (manufactured by Canon Inc.) are connected, and an electrolytic solution uses a first grade sodium chloride to adjust 1% NaCl aqueous solution.

As for the measuring method, a surface active agent (preferably alkylbenzenesulfonic acid salt) of 0.1 to 5 ml as a dispersing agent is added to the above-described electrolytic solution of 110 to 150 ml, and a measuring sample of 0.5 to 50 mg is further added.

The electrolytic solution which suspended the sample performs a dispersing process for about one to three minutes by an ultrasonic dispersing device and measures a particle size distribution of the particles of 2 to 40 $\mu$m and calculates a volume distribution by using a 100 $\mu$m aperture as an aperture by the Coulter counter Model TA-II. By these calculated volume distributions, the volume average particle size of the sample can be obtained.

As for magnetization of the magnetic carrier, what is conventionally known can be used. For example, a resin carrier may be formed by dispersing magnetite as a magnetic material in the resin and making it conductive and dispersing carbon black for a resistance adjustment purpose, the carrier may be subjected to a resistance adjustment by oxidizing or deoxidize-processing the surface of a magnetic carrier core particle such as a ferrite particle, or the carrier may be subjected to a resistance adjustment by coating the surface of a magnetic carrier core particle such as a ferrite with a resin. The production method of these magnetic carriers is not particularly limited.

It is preferable that the magnetic carrier has a magnetization of $3.0\times10^4$ A/m to $2.0\times10^5$ A/m in a magnetic field of 0.1 tesla. When the magnetization of the magnetic carrier is smaller than this range, stable adhesion of the magnetic generating means to the non-magnetic cylinder becomes difficult and a faulty image, such as decreasing image density and the like, is sometimes produced. Further, when the magnetization of the magnetic carrier is larger than this range, compression of the developer while being conveyed by the non-magnetic cylinder increases and the desired longevity of the developer is sometimes not attained.

The magnetization of the carrier was measured by using an oscillation magnetic field type magnetic property automatic recording apparatus BHV-30 made by Riken Denshi Co., Ltd. The magnetic property value of carrier powder is obtained by strength of the magnetization when an external magnetic field of 0.1 T is created. The carrier is in a packed state so as to be sufficiently tight in a plastic container of a cylindrical shape. In such a state, a magnetization moment is measured and an actual weight at the time the sample was put in is measured, and the strength of the magnetization is calculated ($Am^2$/kg). Subsequently, a true specific gravity of the carrier particle is calculated by a dry type automatic density meter accupick 1330 (manufactured by Shimadzu Corp.) and, by multiplying the strength of the magnetization ($Am^2$/kg) by the true specific gravity, the strength (A/m) of the magnetization per unit volume used in the present invention is calculated.

Further, it is preferable that the magnetic carrier has a weight average size of 20 to 100 $\mu$m and still further preferably 20 to 70 $\mu$m. When the weight average size of the magnetic carrier is smaller than this range, the conveyance ability of the non-magnetic toner sometimes becomes insufficient and, when it is larger than this range, it sometimes adversely affects a flowability, a chargeability and a conveyance ability of the two component developer.

The weight average size of the magnetic carrier may be measured in a manner similar to or corresponding to the measurement of the particle size of the non-magnetic toner or may be measured by a sifting method, wherein sieves of different meshes are piled up one on another in order of large mesh size and a sifting out operation is performed by putting a sample previously measured for the weight on a topmost sieve and a residual amount on each mesh is measured and displayed by an integrating percentage with a total amount.

The two component developer may be a developer containing another material which is suitably used in addition to the non-magnetic toner and the magnetic carrier. As such "another" material, an external additive and the like for controlling a flowability and a chargeability of the developer can be used.

The external additive has two effects hardware-wise for the non-magnetic toner and further by coating the surface of the non-magnetic toner. One is that the flowability is improved so that a replenished toner can be easily mixed and agitated with the two component developer inside the developer container and another is that the external additive intervenes on the toner particle surface so that a releasing ability relative to the photosensitive drum of the non-magnetic toner supplied onto the photosensitive drum by the developer is enhanced, thereby improving a transfer efficiency.

As for the external additive used in the present invention, in terms of the durability at the time when it was added to the non-magnetic toner, it is preferable that it has a numerical value of the number average particle size equal to or less than 1/10 of the numerical value of the weight average size of the non-magnetic toner particle. What is meant by the particle size and the number average particle size of the external additive is the average particle size calculated from the surface observation of the toner particle in an electron microscope.

As for the external additive, various types of inorganic and organic chemical compounds, which have been conventionally known as the external additives, can be used. For example, metallic oxide (such as aluminum oxide, titanic oxide, titanic acid strontium, cerium oxide, magnesium oxide, chromic oxide, tin oxide, zinc oxide and the like), nitride (silicon nitride), carbide (such as silicon carbide), metallic salt (such as calcium sulfate, barium sulfate, calcium carbonate and the like), fatty acid metallic salt (such as zinc stearate, calcium stearate and the like), carbon black, silica and the like can be used.

The external additive is used in 0.01 to 10 parts by weight based on 100 parts by weight of the non-magnetic toner particle and preferably is used in 0.05 to 5 parts by weight. The external additive may be singly used or jointly used with a plurality of additives. Further, it is more preferable to use the additives, which are respectively subjected to a hydrophobic treatment.

The examples of the present invention will be described below with the accompanied drawings.

EXAMPLE 1

FIG. 1 shows a color printer of an electrophotographic system which the present invention can adopt. This printer comprises an electrophotographic photosensitive drum (an image bearing member) 3 which rotates in an arrow direction and, around the photosensitive drum 3, there are arranged a rotational developing apparatus 1 comprising a charging device 4 and developing devices (developing apparatuses) 1M, 1C, 1Y and 1Bk, a transfer charging device 10, cleaning means 12 and image forming means comprising LED exposure means and the like installed above the photosensitive drum 3 in FIG. 1. In each developing device, two component developer containing a non-magnetic toner and a magnetic carrier particle is housed. The developer of the developing device 1M houses a non-magnetic magenta toner and the magnetic carrier, the developer of the developing device 1C a non-magnetic cyan toner and the magnetic carrier, the developer of the developing device 1Y a non-magnetic yellow toner and the magnetic carrier and the developer of the developing device 1Bk a non-magnetic black toner and the magnetic carrier.

An original to be copied is read by an original reading device not shown. This reading device comprises a photoelectric transfer element (for example, CCD), which converts an original image into electric signals and outputs image signals respectively corresponding to magenta image information, cyan image information, yellow image information and black and white image information of the original. LED exposure means is controlled for an on-off emission corresponding to these image signals and performs an exposure operation. It can also print out output signals from an electronic calculator. The whole sequence of the color printer will be briefly described with reference to the case of a full color mode.

The charging device 4 uniformly charges the photosensitive drum 3. Next, an exposure operation is performed by an LED array L controlled by the magenta image signal, and a dot distribution latent image is formed on the photosensitive drum 3. This latent image is reverse developed by the magenta developing device 1M, which is fixed in advance on the developing position.

The transfer material, such as a paper sheet which was taken out from a cassette C and advanced through a paper feed guide 5*a*, a paper feed roller 6 and a paper feed guide 5*b*, is held by a gripper 7 of a transfer drum 9 and electrostatically wound around the transfer drum 9 by an abutting roller 8 and its opposing pole. The transfer drum 9 rotates in the illustrated arrow direction in synchronization with the photosensitive drum 3, and a magenta manifested image developed by the magenta developing device 1M is transferred onto the transfer material by the transfer charging device 10 in the transfer portion. The transfer drum 9 continues its rotation and prepares for the transfer of the next color (cyan in FIG. 1) image.

On the other hand, the photosensitive drum 3 is charge-neutralized by the charging device 11, cleaned by the cleaning means 12, charged again by the charging device 4 and subjected to an exposure as described above by the LED array L controlled by the next cyan image signal, thereby forming an electrostatic latent image. During this time, the developing apparatus 1 rotates and, with the cyan developing device 1C stationed in a predetermined developing position, performs reverse developing of the electrostatic latent image corresponding to cyan and forms a cyan manifested image.

Subsequently, the following steps are performed for the yellow image signal and the black image signal, respectively, and, when the transfer of a four-color manifested image (a toner image) is completed, the transfer material is charge-neutralized by charging devices 13, 14 and released by gripper 7; at the same time, the paper sheet is separated from the transfer drum 9 by a separating claw 15 and forwarded to a fixing device (a hot pressing roller fixing device) 17 by a conveyer belt 16. The fixing device 17 fixes the four color manifested images superposed on the transfer material. In this way, a series of the full color print sequence is completed and a desired full color print image is formed.

The present constitution is one example and there are various systems where, for example, the charging device 4 is not a corona charging device, but a charging roller and the exposure means is a semiconductor laser and the transfer charging device 10 is also a transfer roller. However, basically as described above, going through the steps of charging, exposing, developing, transferring and fixing forms the image.

Next, one of the developing devices, 1M in the image forming method of the present invention, will be described with reference to the drawings.

Figure 3:
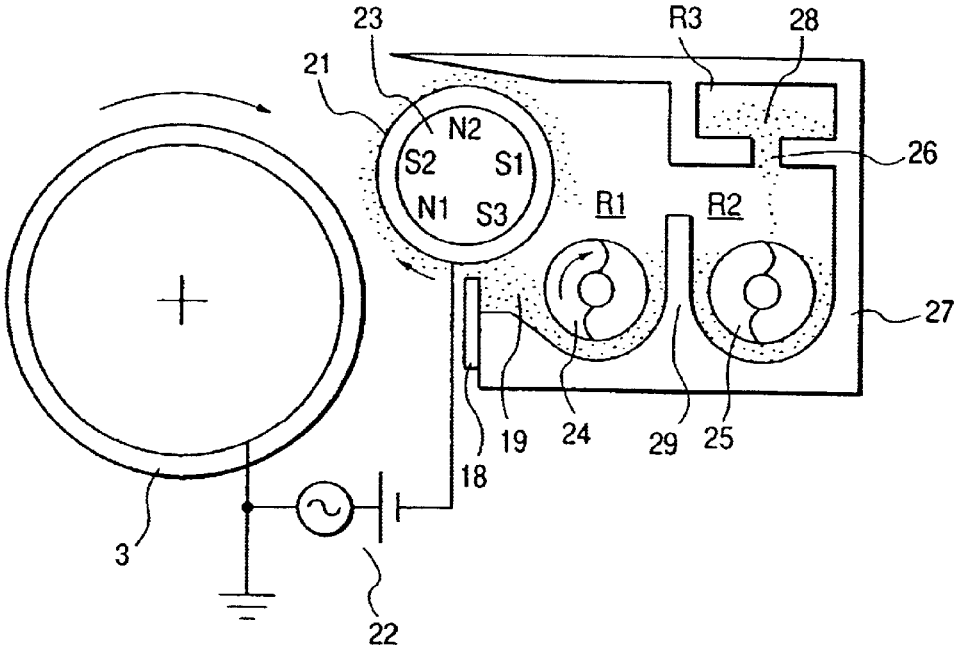
FIG. 3 is a sectional view of the developing device showing one example of the present invention.

FIG. 3 is a block diagram showing the developing device 1M used in the example of the present invention. The present developing device is, as shown in FIG. 3, provided with a developer container 27. The interior of the developer container 27 is zoned as a developing chamber (the first chamber) R1 and an agitating chamber (the second chamber) R2 by a partition wall 29. Upward of the agitating chamber R2, a toner storage chamber R3 is formed with the partition wall 29 therebetween, and inside the toner storage chamber R3 a replenishment toner (a non-magnetic toner) 28 is housed. The toner storage chamber R3 is installed with a replenishing port 26 and the amount of the replenishment toner 28 which corresponds to the toner consumed through the replenishing port 26 drops inside the agitating chamber R2 and the developer stored in the agitating chamber R2 is replenished.

In contrast to this, inside the developing chamber R1 and the agitating chamber R2, the developer (the two component developer) 19 is housed. The developer 19 used in the present example is produced by a pulverizing method and is a two component developer, comprising: non-magnetic toner (hereinafter referred to as "toner") having a frictional electrification of about $-2.0\times10^2$ C/kg and an average particle size of 8 $\mu$m; titanium oxide fine particles having an average particle size of 20 nm with 1% weight ratio externally added to the toner; and magnetic carrier having a magnetization value of $2.7\times10^5$ A/m in 0.1 tesla and an average particle size of 35 μm (a mixing ratio of the magnetic carrier is such that the non-magnetic toner has a weight ratio of about 7% for the whole developer).

In the portion adjacent to the photosensitive drum 3 of the developing container 27, an opening portion is provided and from this opening portion a developing sleeve (a non-magnetic cylinder) 21 is projected outside: The developing sleeve 21 is rotatably incorporated in the developer container 27 and, in the present example, the developing sleeve 21 comprises, for example, a non-magnetic material such as SUS305AC and, in its interior, a magnet 23, which constitutes magnetic field generating means, is fixed. Further, a developing sleeve having a diameter of 16 mm was used.

The magnet 23 comprises a developing magnetic pole N1, a developer layer thickness control pole S3 positioned in the developing magnetic pole N1 and in its downstream, magnetic poles N2 and S2 for conveying a developer 19 and a stripping off pole S1. The magnet 23 is arranged inside the developing sleeve 21 in such a manner that the developing magnetic pole N1 opposes the photosensitive drum 3. The developing magnetic pole N1 forms a magnetic field in the vicinity of the developing portion between the developing sleeve 21 and the photosensitive drum 3 and a magnetic brush is formed by the magnetic field. In this position, the developer which has been conveyed in the arrow direction together with the developing sleeve 21 contacts the photosensitive drum 3 and the electrostatic latent image on the photosensitive drum 3 is developed.

On this occasion, in the vicinity position (the developing portion) between the developing sleeve 21 and the photosensitive drum 3, the developing sleeve 21 and the photosensitive drum 3 move in opposite directions (counter direction). The developer, which has completed the development at the N1 pole, is stripped off from the developing sleeve by the repulsive magnetic field formed by the S1 and the S3 poles and drops into the developing chamber R1.

The developing sleeve is applied with a vibration bias voltage with a direct current voltage superposed on an alternating current voltage by a power supply source 22. The dark portion potential (the non-exposure portion potential) and the light portion potential (the exposure portion potential) of the latent image is positioned between the maximum value and the minimum value of the vibration bias potential. In this way, in the developing portion, an alternating electric field in which the direction mutually changes is formed. In this alternating electric field, the toner and the carrier intensely vibrate and a toner amount corresponding to a latent image potential is adhered on the photosensitive drum 3 by shaking off an electrostatic restriction toward the developing sleeve 21 and the magnetic carrier. In the present example, the dark portion potential of the photosensitive drum 3 is taken as −550 V and the light portion potential as −100 V, and the developing sleeve 21 is applied with −300 V as a direct current bias and with Vpp2.0 kV, Frq. 6 kHz as an alternating current bias.

Below the developing sleeve 21, a blade 18 is arranged with the developing sleeve 21 at a predetermined interval. The interval between the developing sleeve 21 and the blade 18 is 400 μm. The blade 18 is fixed to the developer container 27. The blade 18 is composed of a magnetic material such as iron and magnetically controls a layer thickness of the developer 19 on the developing sleeve 21.

Inside the developing chamber R1, a conveyance screw (agitating conveyer means) 24 is housed. The conveyance screw 24 has a screw-shaped blade on an axis having a diameter of 6 mm, and the blade having a diameter of 14 mm and a pitch of 15 mm was used.

The conveyance screw 24 is rotated in a direction shown by the arrow in the drawing, and developer 19 inside the developing chamber R1 is conveyed to the developing sleeve 21 over the whole area by a rotational drive of the conveyance screw 24 along a longitudinal direction of the developing sleeve 21. In the present example, the conveyance screw 24 is arranged downward in the gravitational direction relative to the developing sleeve 21. The reason will be described later, but it is because the topmost surface of the developer housed in the conveyance screw 24 is set between the developer layer thickness control pole and the stripping off pole.

Inside the agitating chamber R2, a conveyance screw 25 is housed. The conveyance screw 25 has the same shape as that of the conveyance screw 24 and has a screw-shaped blade on the axis of 6 mm, and a blade having a diameter of 14 mm and a pitch of 20 mm was used.

The conveyance screw 25 agitates and conveys toner dropped from the replenishing port 26 over the whole area along the longitudinal direction of the developing sleeve 21, and delivers sufficiently agitated developer to the developing chamber R1 side at its end.

Next, the positional relationship among the developer layer thickness control pole, the stripping off pole jointly forming a repulsive magnetic field, and a screw in the vicinity of the developing sleeve, including each operation thereof, will be described in detail.

In the present example, among the S3 pole and the S1 pole, which form the repulsive magnetic field, the S3 pole is used as the developer layer thickness control pole and the S1 pole is used as the developer stripping off pole. It is preferable that the peak value of the strength of the magnetic field in a vertical direction relative to the developing sleeve surface of the S3 pole be not less than 0.04 tesla and not more than 0.1 tesla, and the peak value of the strength of the magnetic field in a vertical direction relative to the sleeve surface of the S1 pole be not less than 0.04 tesla and not more than 0.08 tesla. Further, though the relationship of the strength of the magnetic field of the S3 pole and the S1 pole will be described later, the strength of the magnetic field of the S3 pole is made in absolute value not less than 0 tesla and not more than 0.02 tesla larger than the strength of the magnetic field of the S1 pole. In the present example, the peak value of the strength of the magnetic field of the S3 pole was taken as 0.06 tesla and the peak value of the strength of the magnetic field of the S1 pole was taken as 0.05 tesla.

Further, on the developing sleeve, the positional relationship between the S3 pole and the S1 pole adopts such a constitution that the peak position of the strength of the magnetic field in the vertical direction relative to the developing sleeve surface of the stripping off pole S1 is positioned further upward in the gravitational direction than the peak position of the strength of the magnetic field in the vertical direction relative to the developing sleeve surface of the developer layer thickness control magnetic pole S3.

If constituted in this way, developer remaining after development easily drops away without requiring special stripping off means, and the developer can be easily conveyed to the developing portion by magnetic suction by the developer layer thickness control pole. That is, regarding the stripping off of the developer from the developing sleeve and the supply of the developer to the developing sleeve, a simple constitution can be set up.

Further, the peak position of the strength of the magnetic field in the vertical direction relative to the developing sleeve surface of the S3 pole and the top end of the control blade (the developing sleeve side) are taken as making an angle of 5° (with the center position of the developing sleeve taken as a standard) in the present example.

Because a repulsive magnetic field is formed between the S3 pole and the S1 pole, the magnetic lines of force of the S3 pole tend to emit vertically relative to the developing sleeve. As a result, a rate of change of the magnetic field (the density of the magnetic lines of force) in the vertical direction relative to the developing sleeve become smaller. This is equivalent to the fact that the force attracting the developer to the developing sleeve becomes smaller. If such a constitution is adopted, the force by which the developer is compressed in the developer layer thickness control pole is weakened so that deterioration of the developer, such as toner deterioration, and the occurrence of spent carrier is controlled and the life of the developer can be extended.

However, in the case where one magnetic pole of the repulsive magnetic poles was used as the developer layer thickness control pole and the positional relationship on the developing sleeve between the developer layer thickness control pole S3 pole and the stripping off pole S1 pole was simply constituted in such a manner that the peak position of the strength of the magnetic field in the vertical direction relative to the developing sleeve surface of the stripping off pole S1 is positioned further upward in the gravitational direction than the peak position of the strength of the magnetic field in the vertical direction relative to the developing sleeve surface of the developer layer thickness control magnetic pole S3, when the developer surface in the vicinity of the developing sleeve was relatively low, a screw pitch shaped density irregularity occurred at the rear end of a solid black image.

This phenomenon occurs when, after the development is completed, developer which has moved to the developer layer thickness control magnetic pole after having been stripped off by the repulsive magnetic field and developer which has been agitated and conveyed by the screw and supplied to the developer layer thickness control pole are mixed, and the mixing ratio thereof changes in a longitudinal image area by a rotational cycle of the screw. Particularly when the toner density of the stripped off developer is low at the rear end of the image, it becomes a density irregularity and easily conspicuous.

As a result of experimental study, it was found that, if the surface of the developer in the agitating screw in the vicinity of the developing sleeve is as follows, screw pitch-shaped density irregularity occurs with difficulty. That is, it is sufficient to set up the developer surface between the peak position of the strength of the magnetic field vertical relative to the developing sleeve surface of the developer layer thickness control pole and the peak position of the strength of the magnetic field vertical to the developing sleeve surface of the stripping off pole. If the developer surface is set in this position, it is because the developer after having been stripped off is interrupted just by the fact that the developer exists there and it is hard to spatially move the developer to the developer layer thickness control pole and, further, it is because the mixing ratio of the developer supplied to the developer layer thickness control magnetic pole can be increased compared with the amount of the developer having the image hysteresis after the stripping off.

Further, if the relationship of the strength of the magnetic field in the vertical direction relative to the developing sleeve surface of the two magnetic poles (in the present example, the S3 pole (the developer layer thickness control pole) and the S1 pole (the stripping off pole)) which form the repulsive magnetic field is as follows, screw pitch-shaped density irregularity occurs with difficulty. This is a constitution where the absolute value of the strength of the magnetic field of the developer layer thickness control magnetic pole is 0.02 tesla not less than the absolute value of the strength of the magnetic field of the stripping off pole. If this relationship becomes larger than 0.02 tesla, it is because the developer, which has completed developing, is easily moved from the stripping off pole to the developer layer thickness control pole.

On this occasion, if the absolute value of the strength of the magnetic field of the developer layer thickness control magnetic pole is made the same or larger than the absolute value of the strength of the magnetic field of the stripping off pole, the circulation of the developer around the developing sleeve becomes smoother in the constitution such as that of the present example. When the strength of the developer layer thickness control pole is smaller than the strength of the magnetic field of the stripping off pole, developer after development gathers too much in the stripping off pole and developer reservoiring in the vicinity of the developer layer thickness control pole reversely becomes little so that pressure to the developer in the developer layer thickness control portion becomes smaller and a coating irregularity of the developer on the developing sleeve occurs easily. Further, in such a state, the developer surface becomes lower so that an irregularity of the supply amount on the developing sleeve due to rotation of the screw becomes a coating irregularity on the sleeve with a result that screw pitch irregularity sometimes occurs.

Further, in the present example, as shown in FIG. 3, though the photosensitive drum 3 and the developing sleeve 21 are constituted in such a manner as to rotate in a counter direction in the developing portion, the present invention is not limited to this. However, as shown in FIG. 3, if the developer layer thickness is controlled downward in the gravitational direction of the developing device, it is easier to make a constitution such as that of the present constitution in which the condensation of the developer is small. The reason is because the developer which is not absorbed by the developing sleeve exits downward in the gravitational direction inside the container and, as its merits, it is cited that, in the case where the transfer portion is positioned downward of the photosensitive drum, if the developing sleeve and the photosensitive drum are constituted in such a manner as to rotate in a counter direction, the constitution of the developing device becomes more simple.

As described above, a full color printer using a two component developer is provided with a developer layer thickness control pole S3 and a stripping off pole S1 which comprises the same magnetic pole as the developer layer thickness control pole S3 and is arranged adjacent to the control pole at the upper side in the gravitational direction of the control pole and forms a magnetic field for stripping off the two component developer supplied for development from the non-magnetic cylinder, wherein the peak value of the strength of the magnetic field of the developer layer thickness control pole S3 in the vertical direction relative to the outer periphery of the developing sleeve 21 is larger than the peak value of the strength of the magnetic field of the stripping off pole S1 in the vertical direction relative to the outer periphery by not less than 0 tesla and not more than 0.02 tesla in absolute value and the conveyance screw 24 is arranged in such a manner that the topmost surface of the developer conveyed by the conveyance screw 24 is positioned between the peak position of the strength of the magnetic field of the developer layer thickness control pole S3 in the vertical direction relative to the outer periphery of the developing sleeve 21 and the peak position of the strength of the magnetic field of the stripping off pole S1 in such direction, so that further miniaturization of the apparatus and further longevity of the developer were attained and uniform solid black image without having any screw pitch-shaped density irregularity could be formed.

EXAMPLE 2

In the present example, a magnetic carrier having a magnetization of $1.5\times10^5$ A/m in the magnetic field of 0.1 tesla was used as the magnetic carrier in the two component developer. All the other conditions were taken as the same as those of Example 1.

Similar to Example 1, Example 2 is constituted in such a manner that one magnetic pole of the repulsive magnetic poles is taken as the developer layer thickness control magnetic pole and, further in the present example, by adopting a constitution where the strength of the magnetization of the carrier is made small, a compressive force of the developer in the developer layer thickness control pole is weakened, and thereby the developer life is further extended.

However, in the case where the magnetization of the magnetic carrier is simply minimized, it is much harder than in Example 1 to strip off developer after development, and the screw pitch-shaped density irregularity occurs easily. This is because the carrier having a small magnetization becomes magnetically insensitive to the magnetic field and the developer after development easily moves to the developer layer thickness control pole.

As a result of experimental study, similar to the present example, the conveyance screw 24 is installed in such a manner that the topmost surface of the developer conveyed by the conveyance screw 24 is positioned between the peak position of the strength of the magnetic field of the developer layer thickness control pole S3 in the vertical direction relative to the outer periphery of the developing sleeve 21 and the peak position of the strength of the magnetic field of the stripping off pole S1 in such direction, so that further miniaturization of the apparatus and further longevity of the developer were attained and uniform solid black image without having any screw pitch-shaped density irregularity could be formed.

What is claimed is:

1. An image forming apparatus, comprising:

a non-magnetic rotatable cylinder having a diameter of 10 mm to 25 mm;

a plurality of magnetic field generating means disposed inside the non-magnetic cylinder and fixed relative thereto;

a developing container which houses a two component developer containing a magnetic carrier and a non-magnetic toner, said non-magnetic cylinder being rotatably mounted at an opening portion thereof;

agitating conveyer means, disposed inside the developing container, which agitates the two component developer and conveys it to said non-magnetic cylinder; and an image bearing member arranged in opposition to the non-magnetic cylinder at intervals, wherein said image forming apparatus conveys the two component developer by rotation of the non-magnetic cylinder, and an electrostatic latent image on said image bearing member is magnetic-brush-developed, wherein said magnetic field generating means comprises: a developer layer thickness control pole for controlling a developer layer thickness on said non-magnetic cylinder of the developer supplied by the agitating conveyer means; and a stripping off pole having the same magnetic polarity as the developer layer thickness control pole and arranged adjacent to the developer layer thickness control pole in the upper side of the gravitational direction of the developer layer thickness control pole and forming a magnetic field for stripping off the two component developer supplied for development from the non-magnetic cylinder, wherein the peak value of the strength of the magnetic field of the developer layer thickness control pole in the direction perpendicular to an outer peripheral surface of said non-magnetic cylinder is less than 0 tesla to 0.02 tesla in absolute value greater than the peak value of the strength of the magnetic field of the stripping off pole in the direction perpendicular to the outer peripheral surface of said non-magnetic cylinder, wherein said agitating conveyer means is installed in such a manner that the topmost surface of the developer conveyed by the agitating conveyer means is situated between the peak position of the strength of the magnetic field of the developer layer thickness control pole in the direction perpendicular to the outer peripheral surface of said non-magnetic cylinder and the peak position of the strength of the magnetic field of the stripping off pole in the direction perpendicular to the outer peripheral surface of said non-magnetic cylinder;

wherein the magnetic carrier in the two component developer has a magnetization of $3.0\times10^4$ A/m to $2.0\times10^5$ A/m in a magnetic field of 0.1 tesla, the non-magnetic toner has a frictional electrification of $-1\times10^{-2}$ C/kg to $-4.5\times10^{-2}$ C/kg, the non-magnetic toner has a volume average particle size of 4 $\mu$m to 15 $\mu$m, the magnetic carrier has a weight average particle size of 20 $\mu$m to 70 $\mu$m, the non-magnetic toner comprises non-magnetic toner particles and an external additive, the external additive has a number average particle size of a numerical value of not more than 1/10 of the numerical value of the weight average particle size of the non-magnetic toner particles, and the external additive is used in 0.05 part by weight to 5 parts by weight based on 100 parts by weight of the non-magnetic toner particles.

2. The image forming apparatus according to claim 1, wherein said image bearing member and said non-magnetic cylinder move in opposing directions in a developing portion so that development is performed.

3. An image forming method, comprising:

providing a non-magnetic rotatable cylinder having a diameter of 10 mm to 25 mm;

providing a plurality of magnetic field generating means disposed inside the non-magnetic cylinder and fixed relative thereto;

providing a developing container which houses a two component developer containing a magnetic carrier and a non-magnetic toner, the non-magnetic cylinder being rotatably mounted at an opening portion thereof;

providing agitating conveyer means, disposed inside the developing container, which agitates the two component developer and conveys it to the non-magnetic cylinder;

providing an image bearing member arranged in opposition to the non-magnetic cylinder at intervals, and rotating the non-magnetic cylinder so as to convey the two component developer and magnetic-brush-develop an electrostatic latent image on the image bearing member, wherein providing the magnetic field generating means comprises:

providing a developer layer thickness control pole for controlling a developer layer thickness on the non-magnetic cylinder of the developer supplied by the agitating conveyer means; and providing a stripping off pole having the same magnetic polarity as the developer layer thickness control pole and arranged adjacent to the developer layer thickness control pole in the upper side of the gravitational direction of the developer layer thickness control pole and forming the magnetic field for stripping off the two component developer supplied for development from the non-magnetic cylinder, wherein the peak value of the strength of the magnetic field of the developer layer thickness control pole in the direction perpendicular to an outer peripheral surface of the non-magnetic cylinder is less than 0 tesla to 0.02 tesla in absolute value greater than the peak value of the strength of the magnetic field of the stripping off pole in the direction perpendicular to the outer peripheral surface of the non-magnetic cylinder, wherein the agitating conveyer means is installed in such a manner that the topmost surface of the developer conveyed by the agitating conveyer means is situated between the peak position of the strength of the magnetic field of the developer layer thickness control pole in the direction perpendicular to the outer peripheral surface of the non-magnetic cylinder and the peak position of the strength of the magnetic field of the stripping off pole in the direction perpendicular to the outer peripheral surface of the non-magnetic cylinder;

wherein the magnetic carrier in the two component developer has a magnetization of $3.0\times10^4$ A/m to $2.0\times10^5$ A/m in a magnetic field of 0.1 tesla, the non-magnetic toner has a frictional electrification of $-1\times10^{-2}$ C/kg to $-4.5\times10^{-2}$ C/kg, the non-magnetic toner has a volume average particle size of 4 $\mu$m to 15 $\mu$m, the magnetic carrier has a weight average particle size of 20 $\mu$m to 70 $\mu$m, the non-magnetic toner comprises non-magnetic toner particles and an external additive, the external additive has a number average particle size of a numerical value of not more than 1/10 of the numerical value of the weight average particle size of the non-magnetic toner particles, and the external additive is used in 0.05 part by weight to 5 parts by weight based on 100 parts by weight of the non-magnetic toner particles.

4. The image forming method according to claim 3, wherein the image bearing member and the non-magnetic cylinder move in opposing directions in a developing portion so that development is performed.

5. A developing apparatus, comprising:

a non-magnetic rotatable cylinder having a diameter of 10 mm to 25 mm;

a plurality of magnetic field generating means disposed inside the non-magnetic cylinder and fixed relative thereto;

a developing container which houses a two component developer containing a magnetic carrier and a non-magnetic toner, said non-magnetic cylinder rotatably mounted at an opening portion thereof; and agitating conveyer means, disposed inside the developing container, which agitates the two component developer and conveys it to said non-magnetic cylinder, wherein said developing apparatus conveys the two component developer by rotation of the non-magnetic cylinder and an electrostatic latent image on an image bearing member of an image forming apparatus is magnetic-brush-developed, the image bearing member being arranged in opposition to the non-magnetic cylinder at intervals, wherein said magnetic field generating means comprises: a developer layer thickness control pole for controlling a developer layer thickness on said non-magnetic cylinder of the developer supplied by the agitating conveyer means; and a stripping off pole having the same magnetic polarity as the developer layer thickness control pole and arranged adjacent to the developer layer thickness control pole in the upper side of the gravitational direction of the developer layer thickness control pole and forming the magnetic field for stripping off the two component developer supplied for development from the non-magnetic cylinder, wherein the peak value of the strength of the magnetic field of the developer layer thickness control pole in the direction perpendicular to an outer peripheral surface of said non-magnetic cylinder is less than 0 tesla to 0.02 tesla in absolute value greater than the peak value of the strength of the magnetic field of the stripping off pole in the direction perpendicular to the outer peripheral surface of said non-magnetic cylinder, wherein said agitating conveyer means is installed in such a manner that the topmost surface of the developer conveyed by the agitating conveyer means is situated between the peak position of the strength of the magnetic field of the developer layer thickness control pole in the direction perpendicular to the outer peripheral surface of said non-magnetic cylinder and the peak position of the strength of the magnetic field of the stripping off pole in the direction perpendicular to the outer peripheral surface of said non-magnetic cylinder;

wherein the magnetic carrier in the two component developer has a magnetization of $3.0\times10^4$ A/m to $2.0\times10^5$ A/m in a magnetic field of 0.1 tesla, the non-magnetic toner has a frictional electrification of −1×10−2 C/kg to −4.5×10−2 C/kg, the non-magnetic toner has a volume average particle size of 4 $\mu$m to 15 $\mu$m, the magnetic carrier has a weight average particle size of 20 $\mu$m to 70 $\mu$m, the non-magnetic toner comprises non-magnetic toner particles and an external additive, the external additive has a number average particle size of a numerical value of not more than 1/10 of the numerical value of the weight average particle size of the non-magnetic toner particles, and the external additive is used in 0.05 part by weight to 5 parts by weight based on 100 parts by weight of the non-magnetic toner particles.

6. The developing apparatus according to claim 5, wherein said image bearing member and said non-magnetic cylinder move in opposing directions in a developing portion so that development is performed.

* * * * *

UNITED STATES PATENT AND TRADEMARK OFFICE

CERTIFICATE OF CORRECTION

PATENT NO. : 6,684,046 B2
DATED : January 27, 2004
INVENTOR(S) : Masaru Hibino

It is certified that error appears in the above-identified patent and that said Letters Patent is hereby corrected as shown below:

Column 9,
Line 17, :developer," should read -- developer --.

Column 10,
Line 47, "-1x10-2 C/kg to -4.5x10-2 C/kg" should read -- $-1x10^{-2}$ C/kg to $-4.5x10^{-2}$ C/kg --.

Signed and Sealed this

Twenty-first Day of September, 2004

JON W. DUDAS
*Director of the United States Patent and Trademark Office*